US006034585A

United States Patent [19]

Donhauser

[11] Patent Number: 6,034,585

[45] Date of Patent: Mar. 7, 2000

[54] SWITCHING DEVICE

[75] Inventor: Peter Donhauser, Schwandorf, Germany

[73] Assignee: Siemens AG, Munich, Germany

[21] Appl. No.: 09/171,509

[22] PCT Filed: Apr. 22, 1997

[86] PCT No.: PCT/DE97/00807

§ 371 Date: Oct. 21, 1998

§ 102(e) Date: Oct. 21, 1998

[87] PCT Pub. No.: WO97/41579

PCT Pub. Date: Nov. 6, 1997

[30] Foreign Application Priority Data

Apr. 29, 1996 [DE] Germany ..... 196 17 136

[51] Int. Cl.[7] ..... H01H 67/02

[52] U.S. Cl. ..... 335/132; 335/128; 335/130; 335/106

[58] Field of Search ..... 335/128, 132, 335/105, 130, 131, 129, 106, 202

[56] References Cited

U.S. PATENT DOCUMENTS

| | | | |
|---|---|---|---|
| 4,470,028 | 9/1984 | Vayre et al. | 335/16 |
| 4,513,270 | 4/1985 | Belbel et al. . | |
| 5,163,175 | 11/1992 | Mori et al. | 335/132 |
| 5,233,321 | 8/1993 | Blanchard et al. | 335/132 |
| 5,339,060 | 8/1994 | Blanchard et al. | 335/132 |
| 5,546,062 | 8/1996 | Duchemin | 335/132 |
| 5,594,399 | 1/1997 | Blanchard et al. | 335/132 |
| 5,880,658 | 3/1999 | Donhauser et al. | 335/132 |

FOREIGN PATENT DOCUMENTS

| | | |
|---|---|---|
| 287 752 | 10/1988 | European Pat. Off. . |
| 55 36 39 | 6/1932 | Germany . |
| 45 153 | 1/1966 | Germany . |
| 37 13 412 | 11/1988 | Germany . |
| 44 24 535 | 1/1995 | Germany . |
| 1190247 | 4/1970 | United Kingdom . |

OTHER PUBLICATIONS

*"Low–Voltage Circuit Breaker", H. Franken, Springerverlag, 1970, pp. 211–212. No date.

*Primary Examiner*—Michael L. Gellner
*Assistant Examiner*—Tuyen T. Nguyen
*Attorney, Agent, or Firm*—Kenyon & Kenyon

[57] ABSTRACT

The invention relates to a switching device having a main electromagnetic drive for connecting and disconnecting a moving contact piece to fixed contact elements, and having an auxiliary electromagnetic drive which, in the event of an overload current flowing via the moving contact piece, in the ON state exerts an additional contact pressure of the contact piece on the fixed contact elements. A lever mounted in the moving contact carrier is also is provided to transmit the additional contact pressure.

4 Claims, 2 Drawing Sheets

SWITCHING DEVICE

FIELD OF THE INVENTION

The present invention relates to a switching device.

BACKGROUND INFORMATION

German Patent No. 37 13 412 describes an electromagnetic switching device having an electromagnetic drive, in which, in the overload range, a contact bridge is torn off the contact point abruptly by a rapid disconnector, in order to prevent welding of the contact point.

SUMMARY OF THE INVENTION

The switching device of the present invention includes a main electromagnetic drive, fixed contact elements, a moving contact piece, a moving contact carrier, a contact pressure spring. The moving contact piece is held in a window in the moving contact carrier using the contact pressure spring, which presses the moving contact piece onto the fixed contact elements when the main drive is on. The switching device also includes an auxiliary electromagnetic drive, whose coil winding is in series with one of the fixed contact elements and which, in the event of an overload current flowing via the moving contact piece, exerts an additional contact pressure of the moving contact piece on the fixed contact elements.

The present invention is based on the object of providing an electrical switching device in which the additional contact pressure on the moving contact piece can be upwardly limited.

According to the present invention, the object is achieved in that a lever mounted in the moving contact carrier is provided to transmit the additional contact pressure.

DETAILED DESCRIPTION

Figure 1:
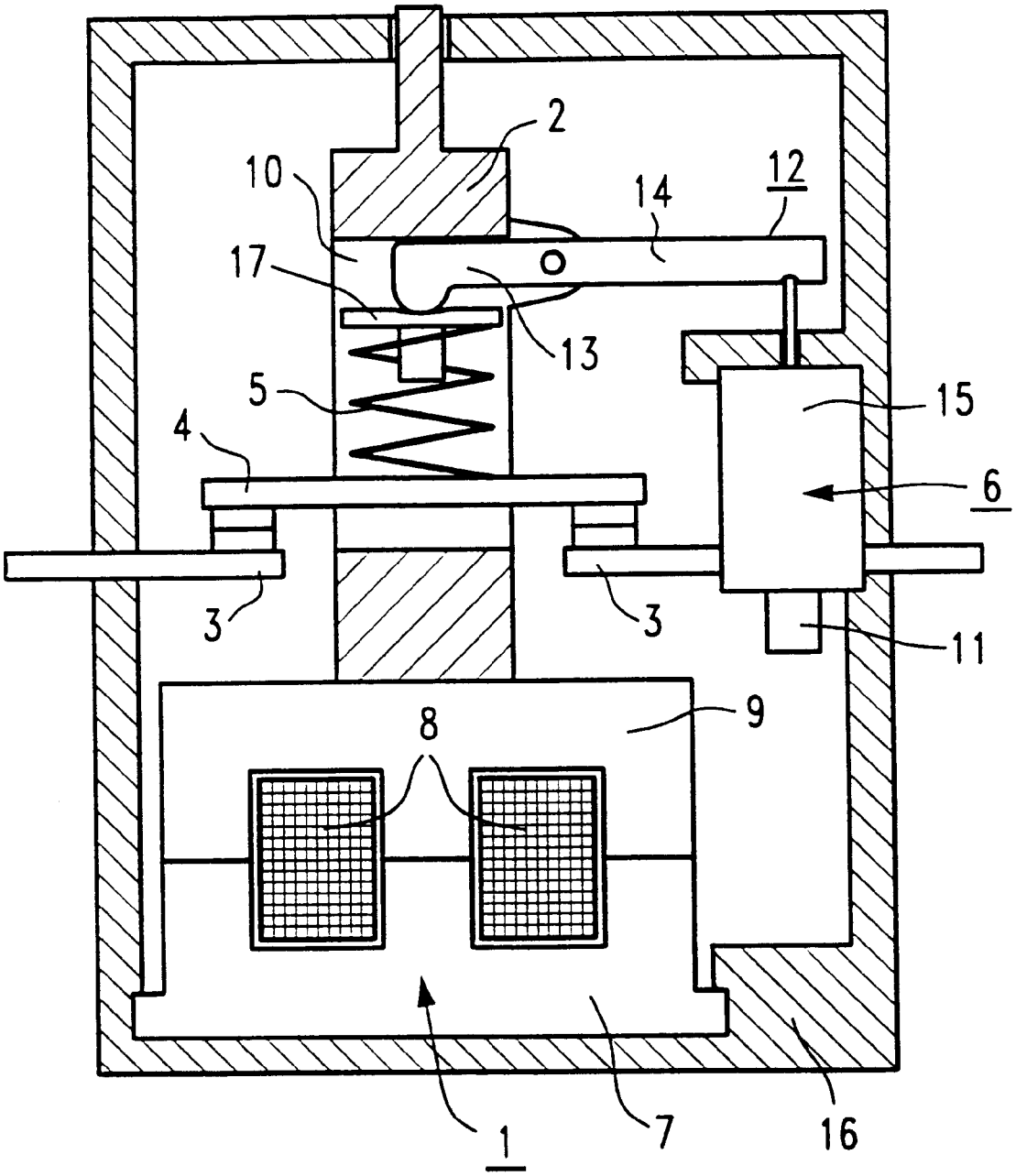
FIG. 1 shows an exemplary embodiment of a switching device according to the present invention.

FIG. 1 shows an exemplary embodiment of a switch device according to the present invention. The switching device includes a main electromagnetic drive 1, a moving contact carrier 2, fixed contact elements 3, a moving contact piece 4, a contact pressure spring 5 and an auxiliary electromagnetic drive 6, all belonging to an electromagnetic switching device. The main electromagnetic drive 1 essentially comprises a fixed yoke 7, a coil winding 8 and a moving armature 9, which is coupled to the moving contact carrier 2. The moving contact piece 4 is held in a window 10 in the moving contact carrier 2 using the contact pressure spring 5. When the main electromagnetic drive 1 is on, according to FIG. 1, the moving contact piece 4 is pressed onto the fixed contact elements 3 by the contact pressure spring 5.

The auxiliary electromagnetic drive 6 has a winding 15, which is in series with one of the fixed contact elements 3, as well as an armature 11 and a push rod that is connected to the latter and to a lever 12 that is mounted in the moving contact carrier 2. If an overcurrent flows via the moving contact piece 4, this overcurrent triggers a movement of the push rod 11 of the auxiliary electromagnetic drive 6, which then exerts a force on the moving contact piece 4—initially via the contact pressure spring 5 and directly when the deflection is greater—and thus exerts an additional contact pressure. This avoids arcs which would otherwise occur between the moving contact piece 4 and the fixed contact elements 3. As a result of the fact that the lever 12 is mounted in the moving contact carrier 2 itself, the contact pressure is upwardly limited. The result of the additional contact pressure from the main current loop is that lower drive forces are required on the control side via the main electromagnetic drive 1, and a larger number of switches or a lower overall volume is made possible. In addition, the components, such as the moving contact piece 4 and the lever 12, need to be designed only up to a specific strength limit. The lever 12 is advantageously rotatably mounted in the manner of a rocker in the moving contact carrier 2, the end of the shorter lever arm 13 being connected to the contact spring 5, for example via a spring cup 17 with a stop, and acting via the contact spring on the moving contact piece 4 or, when the deflection is greater, resting on the moving contact piece 4, and the other, longer lever arm 14 being connected at the end to the armature 11 of the auxiliary electromagnetic drive 6. The auxiliary electromagnetic drive 6, like the main electromagnetic drive 1, is mounted in the housing.

Figure 2:
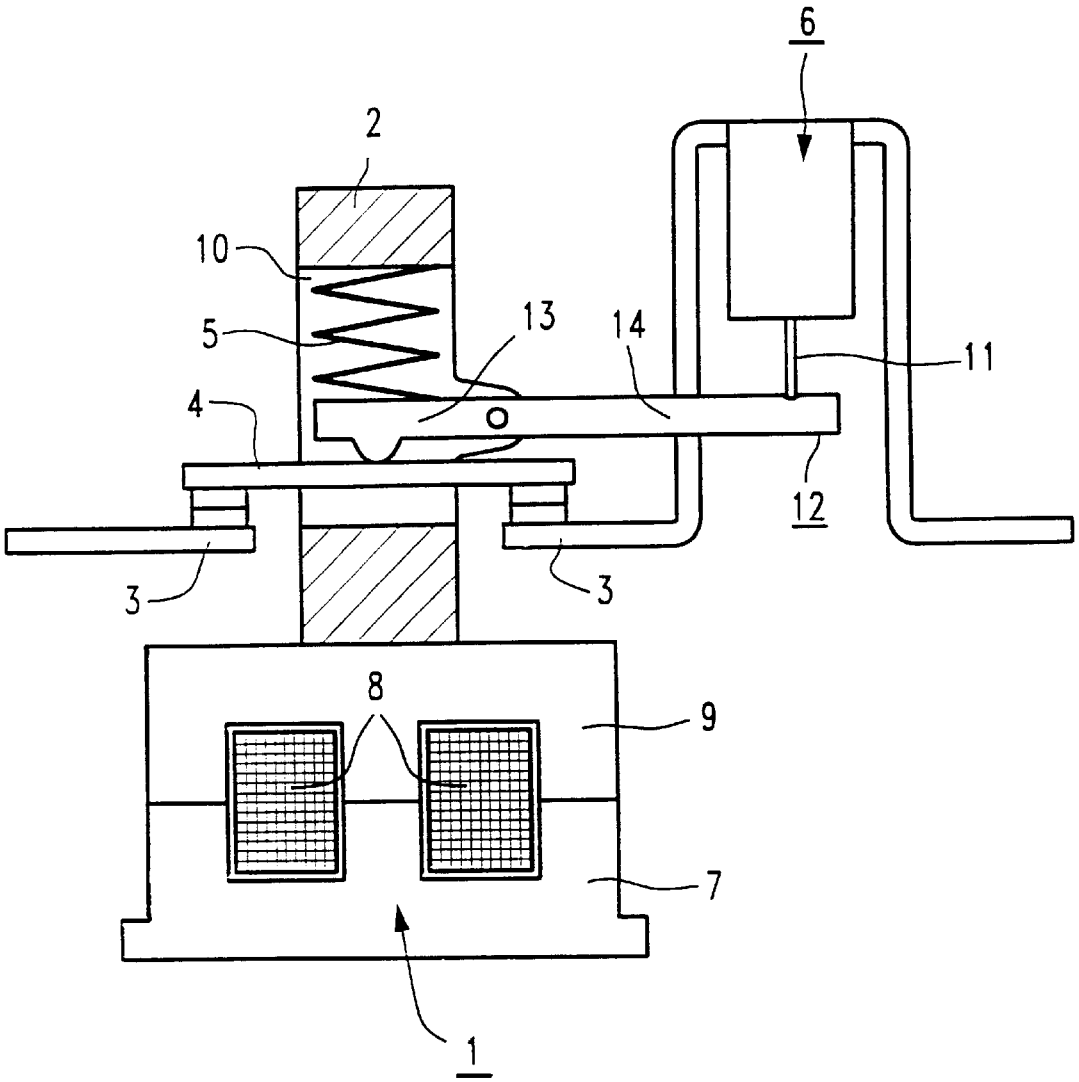
FIG. 2 shows another exemplary embodiment of a switching device according to the present invention.

FIG. 2 shows another exemplary embodiment of the switching device according to the present invention. Here the shorter lever arm 13 may rest directly on the moving contact piece 4 and exert the additional contact pressure.

What is claimed is:

1. A switching device, comprising:

a main electromagnetic drive;

fixed contact elements;

a moving contact piece;

a moving contact carrier;

a contact pressure spring, the moving contact piece being held in a window of the moving contact carrier via the contact pressure spring, the contact pressure spring pressing the moving contact piece onto the fixed contact elements when the main electromagnetic drive is in an "on" state;

an auxiliary electromagnetic drive including a coil winding, the coil winding being coupled in series to one of the fixed contact elements; and a lever mounted in the moving contact carrier, the lever operatively coupled to the auxiliary electromagnetic drive and transmitting a force from the auxiliary electromagnetic drive onto the moving contact piece to provide an additional pressure of the moving contact piece on the fixed contact elements in the event of an overload current flowing via the moving contact piece.

2. The switching device according to claim 1, wherein the lever is rotatably mounted in a rocker manner in the moving contact carrier, the lever including a first lever arm resting on the moving contact piece and a second lever arm coupled to an armature of the auxiliary electromagnetic drive.

3. The switching device according to claim 1, wherein the lever is rotatably mounted in a rocker manner in the moving contact carrier, the lever including a lever arm connected to the contact pressure spring and acting via the contact pressure spring on the moving contact piece, the lever arm resting on the moving contact piece after the contact pressure spring has been deflected.

4. The switching device according to claim 1, wherein the main electromagnetic drive and the auxiliary electromagnetic drive are firmly connected to a housing of the switching device.

* * * * *